US006998587B2

(12) United States Patent
Kirkpatrick et al.

(10) Patent No.: US 6,998,587 B2
(45) Date of Patent: Feb. 14, 2006

(54) APPARATUS AND METHOD FOR HEATING MICRO-COMPONENTS MOUNTED ON A SUBSTRATE

(75) Inventors: Peter E. Kirkpatrick, San Francisco, CA (US); Marc Finot, Palo Alto, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/739,242

(22) Filed: Dec. 18, 2003

(65) Prior Publication Data

US 2005/0133493 A1 Jun. 23, 2005

(51) Int. Cl.
*H05B 3/06* (2006.01)

(52) U.S. Cl. ..... 219/542; 219/534; 219/209

(58) Field of Classification Search ..... 219/209, 219/543, 542

See application file for complete search history.

(56) References Cited

U.S. PATENT DOCUMENTS

| | | | | |
|---|---|---|---|---|
| 4,259,606 A | | 3/1981 | Vig | |
| 4,627,533 A | | 12/1986 | Pollard | |
| 4,744,246 A | * | 5/1988 | Busta | 73/204.26 |
| 5,180,942 A | | 1/1993 | Marvin et al. | |
| 5,438,219 A | | 8/1995 | Kotzan et al. | |
| 5,500,628 A | | 3/1996 | Knecht | |
| 5,659,270 A | * | 8/1997 | Millen et al. | 331/69 |
| 5,917,272 A | | 6/1999 | Clark et al. | |
| 6,274,853 B1 | | 8/2001 | Watanabe et al. | |
| 6,294,771 B1 | | 9/2001 | Katsuda et al. | |
| 6,400,388 B1 | | 6/2002 | Imai | |
| 6,423,944 B1 | | 7/2002 | Watanabe et al. | |
| 6,525,755 B1 | | 2/2003 | Imai et al. | |
| 6,603,093 B1 | | 8/2003 | Epitaux et al. | |

OTHER PUBLICATIONS

"Optima® Laser Diode Application Notes and Glossary," Optima Precision Inc., Dec. 2, 1998.
"Using Digital Potentiometers in Laser Diode Applications," Xicor, May 15, 2001.
"Laser Diodes and Laser Diode Controllers," Tektronix, 2003.
"Basics of Laser Diodes," Tektronix, 2002.
"Keeping Cool—Thermoelectric Coolers Offer Efficient Solid-State Heat-Management Options," oeMagazine. Obtained from http://oemagazine.com/fromTheMagazine/mar01/tutorial.html on Jul. 15, 2003.
Intel application titled "Optoelectronic Package Having A Transmission Line Between Electrical Components And Optical Components," filed Jul. 30, 2002.
Intel application titled "Optoelectronic Modules And Methods Of Manufacturing The Same," filed Feb. 4, 2003.
Intel application titled Single-Ended/Differential Wired Radio Frequency Interface, filed Jul. 30, 2002.
Intel application titled "A Method And Apparatus For A Backsided And Recessed Optical Package Connection," filed (unknown).

* cited by examiner

*Primary Examiner*—Robin O. Evans
*Assistant Examiner*—Vinod Patel
(74) *Attorney, Agent, or Firm*—Marshall, Gerstein & Borun LLP

(57) ABSTRACT

A package for heating a micro-component is disclosed. The package comprises a platform having a resistive heating element integral with the platform. The package further includes a micro-component disposed on the platform.

17 Claims, 2 Drawing Sheets

APPARATUS AND METHOD FOR HEATING MICRO-COMPONENTS MOUNTED ON A SUBSTRATE

FIELD OF THE INVENTION

The present invention relates generally to heating micro-components mounted on a substrate, and more specifically, to an apparatus and method for heating micro-components to minimize temperature fluctuations within the micro-components.

BACKGROUND OF THE INVENTION

Micro-components comprise such components as: semiconductor devices, such as integrated circuits; optoelectronic components, such as laser diodes; and optical components, such as mini-lenses, which are typically mounted on a substrate, such as a circuit board. Operating performance for these micro-components can vary as a function of temperature, and these micro-components often require heat dissipation and/or cooling elements to maintain the micro-components within a desired operating temperature range. To provide a properly functioning micro-component, the operating temperature range must be known and controlled. While excessively high temperature conditions may cause performance problems of individual micro-components, operating temperatures that are too low can also adversely affect performance.

In addition to performance variations of a micro-component based on its temperature, the performance of a micro-component can also vary when the substrate temperature varies from a desired operating temperature. Variation in the substrate temperature from the desired operating temperature results in thermal expansion and contraction causing dimensional variations of the substrate. Moreover, these dimensional substrate variations cause a variation in the relative locations of the components mounted on the substrate. Consequently, control of the substrate temperature is desired.

A semiconductor laser diode (herinafter "laser diode") converts electrical data signals into optical data signals. Several important laser diode operating parameters change as a function of temperature, resulting in poor performance if operated outside of its desired operating temperature range. Often, laser diodes operate in an environment that is too cold. These low temperatures cause performance problems and require additional heat to bring the laser diode to a desired temperature. Therefore, heating the laser diode is desired, and cooling is not necessary.

Thermoelectric (TE) devices are well known and used in the electronics industry to both heat and cool micro-components. However, for micro-components requiring only heating, such functionality is not necessary. For such applications, TE devices are costly and consume valuable real-estate on circuit boards. Furthermore, maintaining the micro-components within an appropriate operating temperature by cooling with TE devices generates waste heat energy resulting in a loss of efficiency.

DETAILED DESCRIPTION OF THE INVENTION

Figure 1:
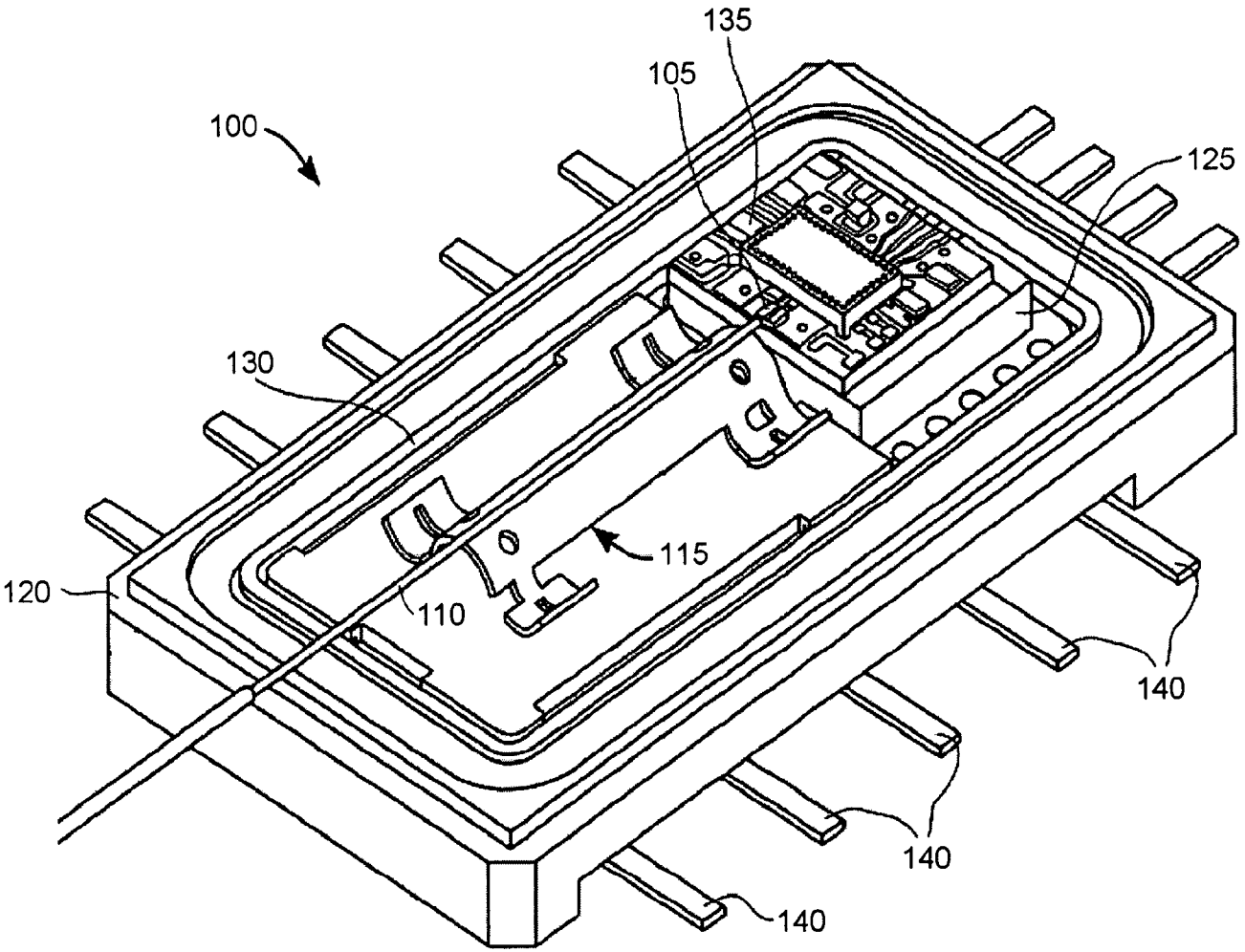
FIG. 1 depicts a diagram illustrating several micro-components within an optical transmitter, in accordance with one embodiment of the present invention.

FIG. 1 shows an optoelectronic assembly package 100 adapted to convert electrical signals into optical signals. The package 100 contains a laser diode 105 to transmit optical signals along an optical fiber 110 supported by an optical fiber mount 115. Individual micro-components in the package 100 are mounted on a platform comprising a substrate 120 and a riser 125. Additionally, a cap (not shown) may be attached to a frame 130, thereby creating a protective seal. The laser diode 105 is mounted on the riser 125 to align the laser diode with the optical fiber 110. FIG. 1 illustrates several micro-components, a controller 137, and electrically conductive patterns 135 also mounted on the riser 125 that are electrically connected to pins 140 mounted to the substrate 120, as is well known. As described below, a resistive heater is integral with the platform beneath the laser diode 105. The heater may be a printed Tantalum Nitride layer on the substrate 120 or riser 125, or embedded within either the substrate 120, or the riser 125. Additionally, a thermistor, as described below, is disposed in thermal proximity to the laser diode 105 to regulate the heater.

Figure 2:
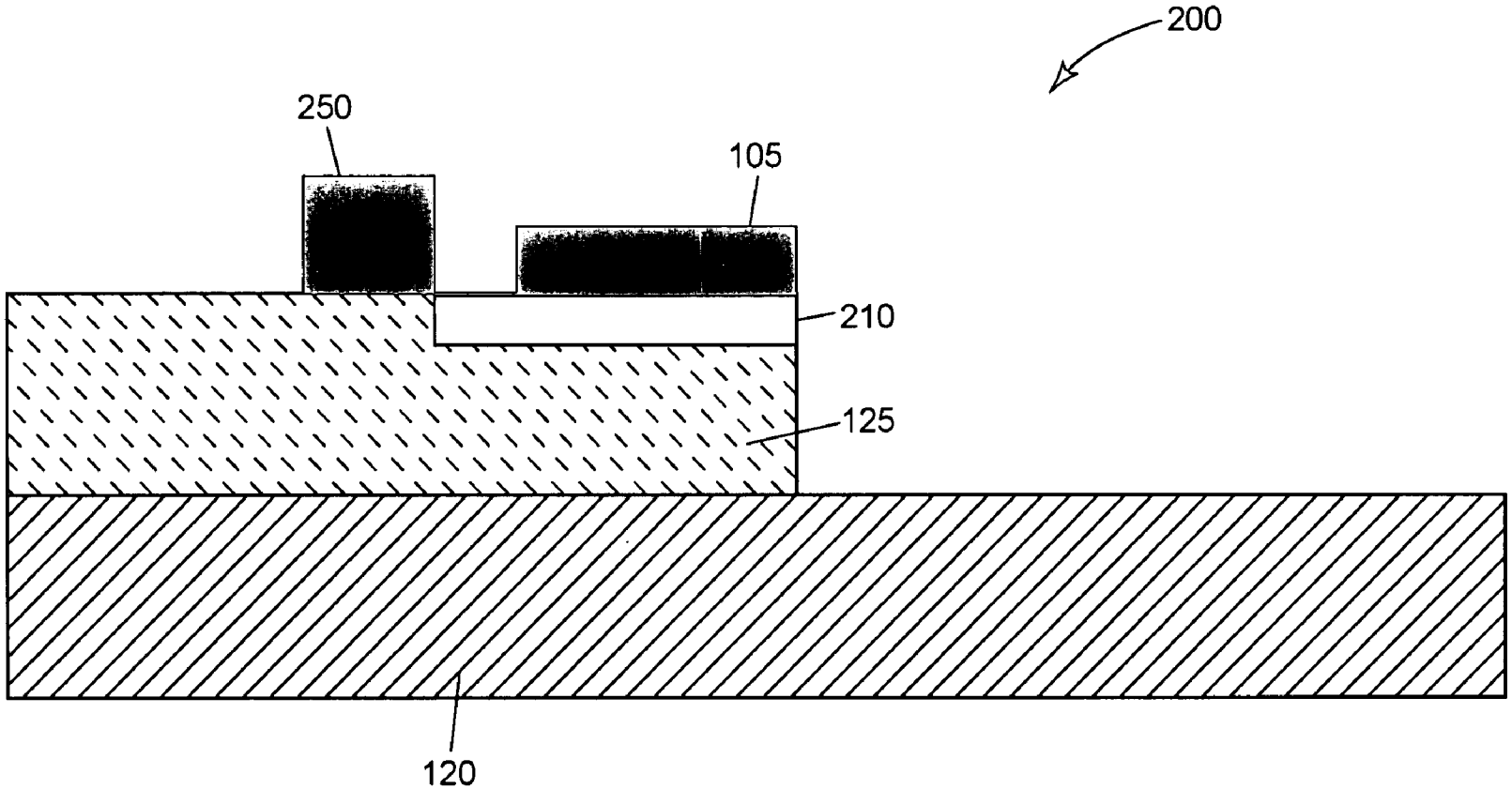
FIG. 2 depicts a block diagram of an apparatus in accordance with the invention.

FIG. 2 shows a resistive heater 210 embedded in the riser 125, directly below the laser diode 105. Alternatively, the resistive heater 210 may be embedded in the substrate 120. A thermistor 250 is mounted in thermal proximity to the laser diode 105 to sense the temperature of the laser diode 105 and provide a temperature signal to regulate the heater 210. The thermistor 250 may also be embedded within the laser diode 105, or embedded within the substrate 120. Alternatively, thermocouples, IC sensors, and RTD elements may be used instead of the thermistor 250. Additionally, the temperature data provided by the thermistor 250 may be used with the controller 137 to energize and de-energize the embedded resistive heater 210 when desired temperature thresholds are exceeded.

While the above description discussed a micro-component consisting of a laser diode, the invention is equally applicable to other components such as: semiconductor devices, such as integrated circuits; other optoelectronic components, such as light emitting diodes; and optical components, such as mini-lenses, which are typically mounted on a circuit board.

Although the foregoing text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the apparatuses described herein are illustrative only and are not limiting upon the scope of the invention.

What is claimed is:

1. A package for a laser diode, the package comprising:

a substrate and a riser mounted on top of the substrate, the riser comprising a top surface with a recess disposed therein, the recess accommodating a resistive heating element, the resistive heating element and the top surface of the riser combining to provide a planar surface for supporting the laser diode and a temperature sensor with the laser diode disposed on top of the resistive heating element, the riser being a solid structure with a portion of the riser disposed between the substrate and the resistive heating element.

2. The package of claim 1, wherein the resistive heating element is embedded within the recess of the riser.

3. The package of claim 1, wherein the resistive heating element is printed in the recess of the riser.

4. The package of claim 3, wherein the resistive heating element is a Tantalum Nitride layer.

5. The package of claim 1, wherein the temperature sensor is a thermistor.

6. The package of claim 1, wherein the temperature sensor engages the laser diode to provide a temperature signal to control the resistive heating element.

7. The package of claim 1, wherein the temperature sensor engages the laser diode and the resistive heating element to provide a temperature signal to control the resistive heating element.

8. A method of heating a laser diode disposed in a package comprising:

providing the package of claim 1; and providing current to resistive heating element disposed beneath the laser diode and between the laser diode and the riser.

9. A package for a laser diode, the package comprising:

a platform comprising a substrate and a riser disposed on top of the substrate, the riser having a mounting location adapted for receiving the laser diode;

a resistive heater integral with the riser and disposed between the laser diode and the riser, the riser and resistive heater combining to provide a planar surface for supporting the laser diode, the riser being solid with a portion of the riser disposed between the heater and the substrate;

a temperature sensor mounted in said planar surface and thermal proximity to the heater and diode, the sensor providing a signal indicative of the temperature of the laser diode and heater; and a controller responsive to the temperature signal for controlling the resistive heater.

10. The package of claim 9, wherein the resistive heater is embedded within a recess disposed in a top surface of the riser.

11. The package of claim 9, wherein the resistive heater is printed on a recess within the riser.

12. The package of claim 11, wherein the resistive heater is a Tantalum Nitride film.

13. A package for a laser diode, the package comprising:

a substrate having a solid riser adapted for receiving and supporting the laser diode;

a resistive heater integral with the riser and beneath the laser diode so the heater is disposed between the laser diode and the riser and further so that the resistive heater and riser combine to provide a planar surface for supporting the laser diode above the substrate, a portion of the riser being disposed between the resistive heater and the substrate;

a thermistor mounted on the riser and in thermal proximity to the laser diode, the thermistor providing a temperature signal indicative of the temperature of the laser diode; and a controller responsive to the temperature signal for controlling the resistive heater.

14. The package of claim 13, wherein the resistive heater is embedded within the riser.

15. The package of claim 13, wherein the resistive heater is a Tantalum Nitride layer.

16. The package of claim 13, wherein the thermistor is embedded within the laser diode.

17. The package of claim 13, wherein the thermistor is embedded within the substrate.

* * * * *